US011073312B2

(12) United States Patent
Blumhardt

(10) Patent No.: US 11,073,312 B2
(45) Date of Patent: Jul. 27, 2021

(54) COOLING FACILITY

(71) Applicant: BITZER Kuehlmaschinenbau GmbH, Sindelfingen (DE)

(72) Inventor: Marcus Blumhardt, Rutesheim (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 130 days.

(21) Appl. No.: 16/126,317

(22) Filed: Sep. 10, 2018

(65) Prior Publication Data

US 2019/0003751 A1 Jan. 3, 2019

Related U.S. Application Data

(63) Continuation of application No. PCT/EP2016/055206, filed on Mar. 10, 2016.

(51) Int. Cl.
*F25B 27/00* (2006.01)
*F25D 15/00* (2006.01)

(52) U.S. Cl.
CPC ..... *F25B 27/00* (2013.01); *F25D 15/00* (2013.01); *F25B 2327/001* (2013.01); *F25D 2323/002* (2013.01)

(58) Field of Classification Search
CPC combination set(s) only.
See application file for complete search history.

(56) References Cited

U.S. PATENT DOCUMENTS 3,692,100 A * 9/1972 Gallagher, Jr. ..... F25D 17/005 165/256
4,103,493 A * 8/1978 Schoenfelder ..... F03G 6/003 60/641.11
4,264,826 A 4/1981 Ullmann
10,253,993 B2 4/2019 Williams
2004/0231331 A1 11/2004 Iwanami et al.
2008/0022707 A1 1/2008 Cho et al.
(Continued)

FOREIGN PATENT DOCUMENTS

DE 27 50 894 A1 3/1979
DE 10 2004 024402 A1 12/2004
(Continued)

*Primary Examiner* — Elizabeth J Martin
(74) *Attorney, Agent, or Firm* — Reinhart Boerner Van Deuren P.C.

(57) ABSTRACT

A facility has a storage unit comprising a housing enclosing a storage volume for receiving goods and/or equipment. It comprises an operating system provided with a tempering unit associated with the storage volume for maintaining a defined or set temperature in the storage volume. The operating system is provided with a refrigerant circuit comprising an internal heat exchanger, arranged in the tempering unit, an external heat exchanger as well as a compressor unit for compressing refrigerant. The operating system is provided with an engine for driving said compressor unit as an independent power source and an electric generator unit mechanically coupled to said engine. The compressor unit and/or the generator unit are driven by the engine independent power source, with the operating system connected to a local energy supply system of said facility to provide a local electric mains power supply system connected to the electric generator unit.

19 Claims, 7 Drawing Sheets

(56) References Cited

U.S. PATENT DOCUMENTS

| | | | | |
|---|---|---|---|---|
| 2015/0292788 | A1* | 10/2015 | Balakrishna | B60P 3/20<br>62/89 |
| 2015/0362231 | A1 | 12/2015 | Matsubayashi et al. | |
| 2018/0087786 | A1* | 3/2018 | Williams | F25B 13/00 |

FOREIGN PATENT DOCUMENTS

| | | | |
|---|---|---|---|
| EP | 2 743 464 | A1 | 6/2014 |
| JP | 2007 239505 | A | 9/2007 |
| WO | WO 2014/070633 | A1 | 5/2014 |

* cited by examiner

COOLING FACILITY

CROSS-REFERENCE TO RELATED PATENT APPLICATION

This application is a continuation of International application number PCT/EP2016/055206 filed on Mar. 10, 2016.

This patent application claims the benefit of International application No. PCT/EP2016/055206 of Mar. 10, 2016, the teachings and disclosure of which are hereby incorporated in their entirety by reference thereto.

BACKGROUND OF THE INVENTION

The invention refers to a facility having a storage unit comprising a housing enclosing a storage volume for receiving goods and/or equipment and further comprising an operating system provided with a tempering unit associated with said storage volume for maintaining a defined or set temperature in said storage volume, said operating system being provided with a refrigerant circuit comprising an internal heat exchanger arranged in said tempering unit, an external heat exchanger as well as a compressor unit for compressing refrigerant.

Usually such facilities are powered via an electric mains power supply system by a power plant.

It is the object of the present invention to enable use of such a facility remote from a power plant and not connected to an electric mains power supply system powered by said power plant.

SUMMARY OF THE INVENTION

This object is solved by a facility as defined before wherein according to the present invention said operating system is provided with an engine for driving said compressor unit as an independent power source and said operating system is provided with an electric generator unit, mechanically coupled to said engine, said compressor unit and/or said generator unit are driven by said engine as independent power source, and said operating system is connected to a local energy supply system of said facility.

It is the advantage of the present invention that on one hand the use of the engine enables use of said facility independent from any mains power supply system powered by a power plant and that energy can be supplied to or obtained from a local energy supply system.

With respect to said local energy supply system it is of particular advantage if said local energy supply system comprises a local electric mains power supply system and/or a local heat supply system.

An advantageous embodiment provides that said generator unit is connected to a local electric mains power supply system comprised by said local energy supply system of said facility in order to feed electric power to said local electric mains power supply system of said facility.

The advantage of this embodiment is that it enables to establish a local electric mains power supply system powered by said generator, so that said facility is enabling use of electric devices in connection with said facility so that said operating system can be the core unit of any kind of private or commercial facility.

In particular it is the advantage of the present invention that said local electric mains power supply system of the facility is not connected to any power plant but only powered by said at least one operating system.

It is of particular advantage if said local electric mains power supply system is designed to supply electric power to at least one of a building equipment, an office equipment and a production equipment.

In particular such an equipment is used in combination with said facility.

It is further of particular advantage if said electric mains power supply system comprises an electric power storage unit, because such electric power storage unit can be used to store electric power generated during driving said generator unit, which electric power can be used in said facility in case said generating unit is not operative.

Further it is of advantage if said electric generator unit is a motor/generator unit, which in a dependent power source mode can receive electric power from said local electric mains power supply system for driving said compressor unit, for example for running said compressor in a "low noise mode" in particular at night.

In an advantageous embodiment it is of advantage if said external heat exchanger of said refrigerant circuit is connected to a local heat supply system comprised by said local energy supply system of said facility.

It is of advantage if said engine is provided with an exhaust heat exchanger connected to a local heat supply system comprised by said local energy supply system of said facility.

It is of advantage if said engine is provided with an engine cooling circuit connected to a local heat supply system comprised by said local energy supply system of said facility.

According to at least one of these embodiments it is not only possible to use the electric energy produced by said generator driven by said engine but also to use any kind of heat generated when running said engine for operation of said private or commercial facility.

In particular it is of advantage if said local heat supply system is connected to a heater associated with said temperature unit in order to enable heating of said storage volume.

Further it is of advantage if said local heat supply system is designed to supply heat to at least one of a building equipment, an office equipment or a production equipment.

In a preferred version the facility is provided with a control enabling operation of said facility in at least one of the following modes

- a general mode in which said engine drives said compressor unit and said generator or motor/generator unit for supplying electric power to said local mains power supply system and heat is supplied to said local heat supply system from at least one of said external heat exchanger, said exhaust heat exchanger and said engine cooling circuit,
- a primary electrical mode in which said engine drives at least said generator or motor/generator unit for supplying electric power to said local mains power supply system,
- a primary tempering mode in which said engine drives at least said compressor unit for providing cooling capacity to said refrigerant circuit,
- a primary heating mode in which said engine supplies heat to said local heat supply system from at least one of said exhaust heat exchanger and said engine cooling circuit.

Said engine is preferably an engine which for example is a combustion engine powered by gaseous or liquid fuel.

It is of particular advantage if said engine is adapted to drive said compressor unit and said generator or motor/ generator unit only so that the engine is only used for powering the operating system according to the present invention.

With respect to the mechanical coupling of said generator or motor/generator unit and said compressor unit no further details have been given so far.

For example it would be possible to couple said generator or motor/generator unit and said compressor mechanically by a belt drive or any kind of gear.

An advantageous and in particular cost efficient solution provides that said generator or motor/generator unit and said compressor unit are directly coupled by a shaft.

In this case the shaft could be a specific coupling shaft arranged between said generator or motor/generator unit and said compressor unit.

It is of particular advantage if said generator or motor/generator unit and said compressor unit are driven by a common drive shaft, which is a shaft of said generator or motor/generator unit as well as a shaft of said compressor unit so that the motor/generator unit and the compressor unit can be combined to one commonly driven device.

In order to efficiently cool the generator or motor/generator unit it is of particular advantage if refrigerant flowing in said refrigerant circuit is flowing through said generator or motor/generator unit for cooling said generator or motor/generator unit.

This means that no specific fan is necessary for cooling said generator or motor/generator unit, because the refrigerant flowing in the refrigerant circuit can be used to cool the generator or motor/generator unit. In particular refrigerant supplied from the internal heat exchanger is used for cooling before it is compressed by said compressor.

One advantageous design provides that said generator or motor/generator unit and said compressor unit are arranged in a common housing.

Arranging both units in a common housing has the advantage that the design is very cost efficient and further the arrangement of both units in a common housing enhances the mechanical stability and reliability of the concept.

According to one preferred solution it is provided that said refrigerant to be compressed is flowing through a compartment within said common housing in which said generator or motor/generator unit is arranged, before entering said compressor unit.

In order to have the option to decouple the engine from said compressor unit, one preferred solution provides that a clutch unit is provided for coupling said engine to said compressor unit so that the clutch unit can be released for decoupling the compressor unit from said engine.

The clutch unit can be designed in various manners.

One preferred solution is to use a magnetic clutch as a clutch unit.

The clutch unit can be arranged on various sides of said compressor unit.

For example, the clutch unit could be arranged on a side of said generator or motor/generator unit opposite said compressor unit.

The clutch unit could also be arranged between said compressor unit and said electric generator or motor/generator unit.

One preferred solution provides that said clutch unit is arranged on a side of said compressor unit opposite to said electric generator or motor/generator unit so that the compressor unit is arranged between the clutch unit and the electric generator or motor/generator unit which leads to a favorable mechanical design because the compressor unit can be designed mechanically so as to be driven from one side by the clutch unit via the engine or from the other side by the electric generator or motor/generator unit.

Preferably the clutch unit is arranged on a common drive shaft of said motor/generator unit and said compressor unit.

However in order to improve the flexibility it is of particular advantage if said engine is adapted to drive said compressor unit and said motor/generator unit only so that the engine is only used for powering the operating system according to the present invention.

With respect to further design aspects of the storage station no further details have been given so far.

Said tempering unit is preferably associated with said storage volume for maintaining a flow of said gaseous medium circulating in said storage volume and passing through said tempering unit in order to be maintained at a defined or set temperature, said tempering unit comprising an internal heat exchanger arranged in said flow of gaseous medium passing through said tempering unit.

For maintaining said flow of gaseous medium within said storage volume it is of advantage that at least one fan unit is provided for generating said flow of said gaseous medium within said storage volume and for having said flow passing through said tempering unit.

Said at least one fan unit can be arranged on various places within said storage volume.

One preferred solution provides that said at least one fan unit is comprised by said tempering unit which enables to blow said flow of gaseous medium directly on a heat exchanger unit within said tempering unit.

Further at least one external fan unit is provided in order to generate a flow of ambient air through said external heat exchanger in order to cool hot refrigerant passing through said external heat exchanger.

In particular said external fan unit can be used for cooling said engine.

In order to be able to heat the flow of gaseous medium under certain conditions, in particular extreme low temperatures outside said storage unit, at least one heater is provided in said tempering unit in order to heat said flow of gaseous medium.

In principal the heater can be arranged independent from the internal heat exchanger.

However, in order to use the heater for defrosting the internal heat exchanger one advantageous solution provides said at least one heater is connected to said internal heat exchanger so that said heater and said internal heat exchanger form a heat exchange unit.

In order to run said storage unit according to the present invention a control is provided for controlling said electric motor/generator unit and said engine during operation of said storage unit.

According to one solution said control controls said electric motor/generator unit and said engine to either run the engine and said motor/generator unit as a generator or to stop the engine and to run the electric motor/generator unit as a motor.

Further it is of advantage if the control is adapted to connect said motor/generator unit to the local electric mains power supply system in order to drive said compressor unit by said motor/generator unit operating as a motor and being powered by said local electric mains power supply system, in particular said electric power storage unit.

Another solution provides that said control is adapted to connect said local electric mains power supply system to at least one of said fan units in order to drive at least one of said fan units by said local electric mains power supply system.

Further an advantageous solution provides a control for controlling the flow of refrigerant in said refrigerant circuit and therefore controlling the operation of said refrigerant circuit.

This control could be different from the control mentioned before.

However one preferred solution provides that the control mentioned before is the same as the control for controlling the flow of refrigerant in the refrigerant circuit.

One specific solution provides that in a cooling mode said refrigerant circuit is controlled to cool said heat exchanger in order to cool said flow of gaseous medium in said storage volume.

Further it is provided that in a heating mode said refrigerant circuit is controlled to heat said internal heat exchanger in order to heat said flow of gaseous medium in said storage volume.

This means that in the heating mode compressed hot refrigerant is not fed to the external heat exchanger but to the internal heat exchanger to heat the internal heat exchanger of the refrigerant circuit, in this case the refrigerant circuit is heated by the heat generated by the generator or motor/generator unit and the heat generated in the course of compression of the refrigerant and this heat is then used to heat the internal heat exchanger.

Another solution provides that in a heating mode said control system controls said heater in order to heat said flow of gaseous medium in said storage volume.

Further improved embodiments of the facility can be provided with other electric power generating units such as for example wind mills provided with an electric generator and/or solar panels all connected to the local electric mains power supply system.

The invention further refers to an operating system for a facility having a storage unit comprising a housing enclosing a storage volume for receiving goods and/or equipment said operating system being provided with a tempering unit associated with said storage volume for maintaining a defined or set temperature in said storage volume, said operating system being provided with a refrigerant circuit comprising an internal heat exchanger, arranged in said tempering unit, an external heat exchanger as well as a compressor unit for compressing refrigerant, characterized in that said operating system is provided with an engine for driving said compressor unit as an independent power source and said operating system is provided with an electric generator unit mechanically coupled to said engine, said compressor unit and/or said generator unit are driven by said engine in said independent power source mode, and said operating system is connected to a local energy supply system of said facility.

With respect to said local energy supply system it is of particular advantage if said local energy supply system comprises a local electric mains power supply system and/or a local heat supply system.

An advantageous embodiment provides that said generator unit is connected to a local electric mains power supply system comprised by said local energy supply system of said facility in order to feed electric power to said local electric mains power supply system of said facility.

It is of particular advantage if said engine is provided with at least one of an exhaust heat exchanger designed to be connected to a local heat supply system comprised by said local energy supply system of said facility, and in particular with an engine cooling circuit designed to be connected to a local heat supply system.

Further features of such an operating system are disclosed in connection with the facility as described before.

Further features and explanations with respect to the present invention are disclosed in connection with the detailed specification and the drawings.

DETAILED DESCRIPTION OF THE INVENTION

Figure 1:
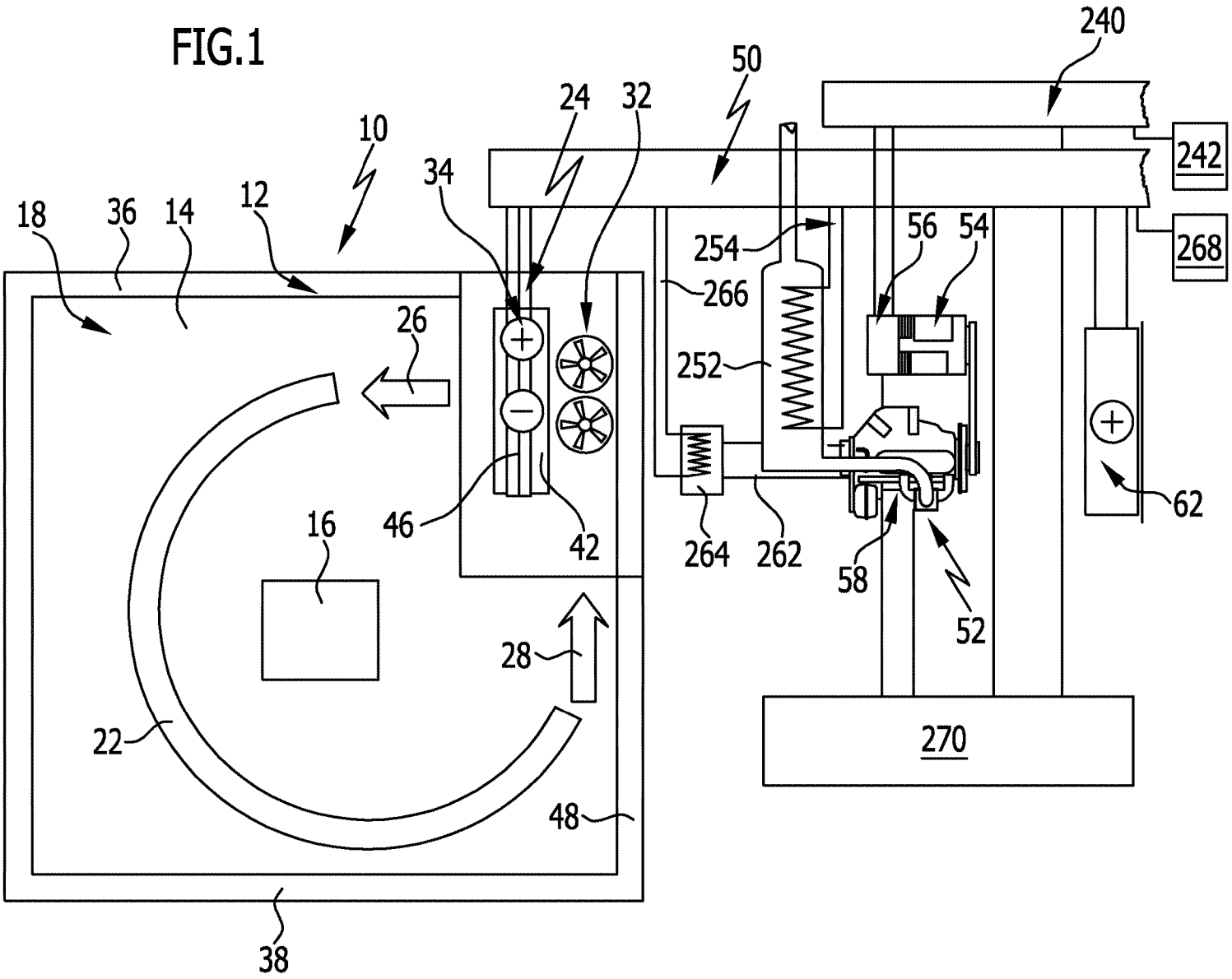
FIG. 1 shows as schematic arrangement of the various features of a facility according to a first embodiment of the present invention.

A first embodiment of an energy optimized facility has a storage unit 10 comprising an insulated housing 12 enclosing a storage volume 14 within which temperature sensitive goods and/or equipment are received surrounded by a gaseous medium, in particular air, which is kept at a defined temperature level for maintaining said goods and/or equipment 16 in a defined temperature range.

In order to maintain a defined or set temperature range of said goods and/or equipment 16 a flow 22 of said gaseous medium 18 is circulating through volume 14 starting from a tempering unit 24 as a supply gas flow 26 and entering tempering unit 24 as a return gas flow 28.

The circulating gas flow 22 is generated by a fan unit 32 preferably arranged within tempering unit 24 and tempered by a heat exchange unit 34 arranged within tempering unit 24.

Preferably supply gas flow 26 exits from tempering unit 24 in an area close to an upper wall 36 of insulated container housing 12 and preferably returns to tempering unit 24 close to a lower wall 38 of insulated container housing 12 forming said return gas flow 28.

Figure 2:
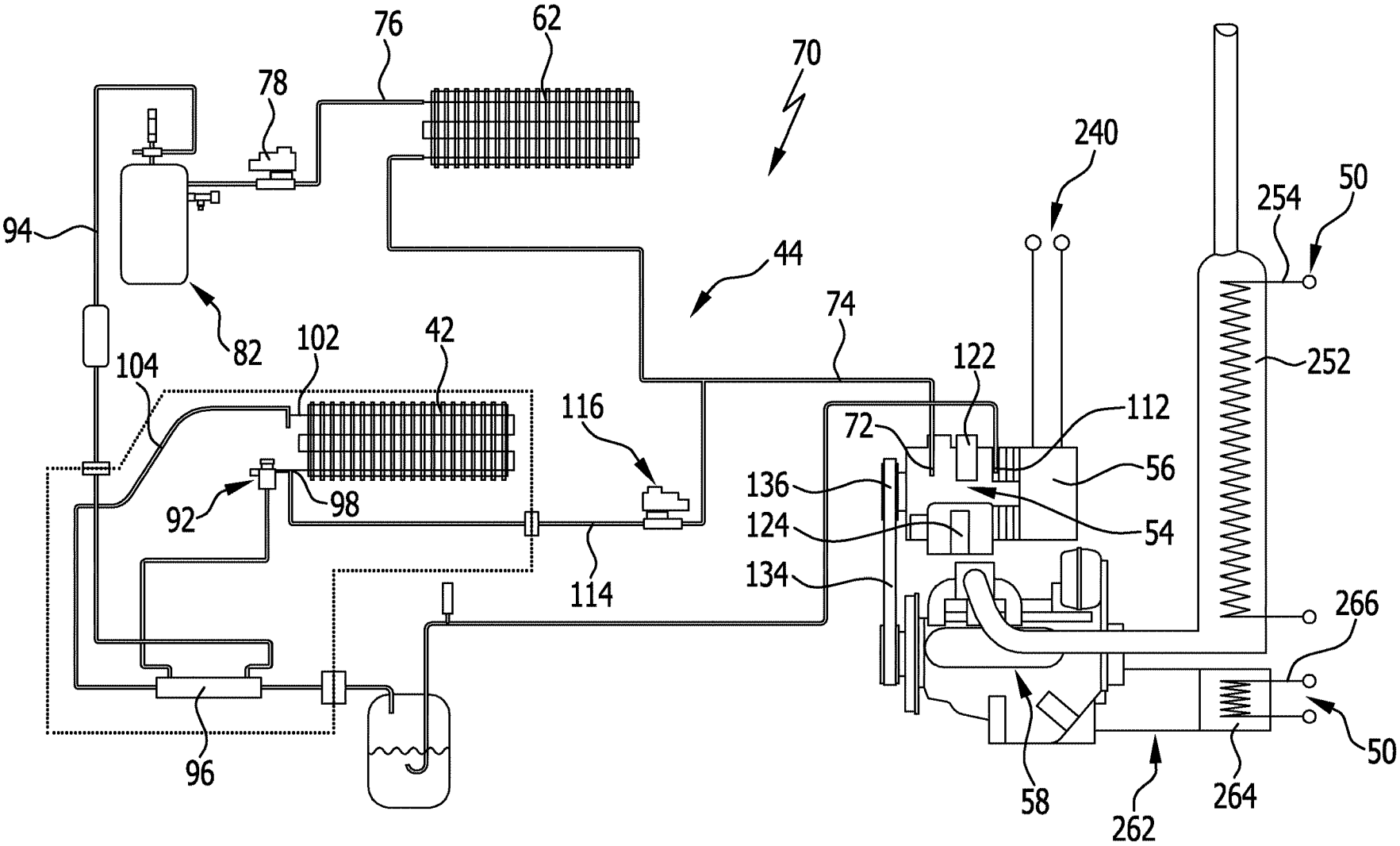
FIG. 2 shows as schematic representation of the refrigerant circuit combined with the motor/generator unit and an engine.

According to a preferred embodiment heat exchange unit 34 comprises an internal heat exchanger 42 arranged in a refrigerant circuit 44 as shown in FIG. 2 as well as heaters 46 which are preferably connected to a local heat supply system 50 explained in detail later.

Tempering unit 24 is arranged close to upper wall 36 of insolated housing 12, for example on a front wall 48 or a rear wall thereof.

However, tempering unit 24 can also be arranged on upper wall 36.

An equipment unit 52 comprises a compressor unit 54 a generator unit 56 as well as an engine 58, in particular a combustion engine powered by gaseous or liquid fuel, said equipment unit 52 is preferably arranged close to tempering unit 24 on insulated housing 12. Supply unit 52 further comprises an external heat exchanger 62 connected to local heat supply system 50.

As can be seen from FIG. 2 compressor 54 as well as external heat exchanger 62 as well as internal heat exchanger 42 are arranged in refrigerant circuit 44.

The components of refrigerant circuit 44 and engine 58 as well as generator unit 56 together form an operating system 70 as shown in FIG. 2.

In particular compressor unit 54 with its discharge port 72 is connected to a discharge line 74 of refrigerant circuit 44 guiding refrigerant compressed at compressor 54 to external heat exchanger 62 in which hot compressed refrigerant is cooled.

Cooled compressed refrigerant leaves external heat exchanger 62 via high pressure lines 76 and enters a liquid receiver 82.

Preferably high pressure line 76 is provided with a valve 78 enabling to control supply of high pressure refrigerant to liquid receiver 82.

Liquid receiver 82 is further connected to expansion device 92 by liquid refrigerant line 94 guiding liquid refrigerant from liquid receiver 82 to expansion device 92.

Preferably a suction line heat exchanger 96 is arranged within liquid refrigerant line 94 in order to subcool liquid refrigerant before expansion in expansion device 92.

Expansion device 92 feeds expanded refrigerant to input port 98 of heat exchanger 42 so that in heat exchanger 42 expanded and cooled refrigerant is able to receive heat before exiting to output port 102 of heat exchanger 42 and entering suction line 104 which after passing through suction line heat exchanger 96 is connected to suction port 112 of compressor 54.

Refrigerant circuit 44 further comprises a hot gas supply line 114 branching off from discharge line 74 and being connected with input port 98 of heat exchanger 42.

Hot gas supply line 114 is further provided with hot gas supply valve 116 which enables to close or open hot gas supply line 114.

In order to control the capacity of or mass flow through compressor unit 54, compressor unit 54 is provided with two capacity control valves 122 and 124 which enable control of the compressor capacity, for example, between 100% compressor capacity if both capacity control valves 122, 124 are open, 50% compressor capacity if one compressor control valve 122 is open and the other compressor control valve 124 is closed, and 0% if both compressor control valves 122, 124 are closed.

As shown in FIG. 2 compressor unit 54 can be driven by an internal combustion engine 58 driving for example a belt drive 134 which then drives a clutch unit 136 connected with compressor unit 54.

Figure 3:
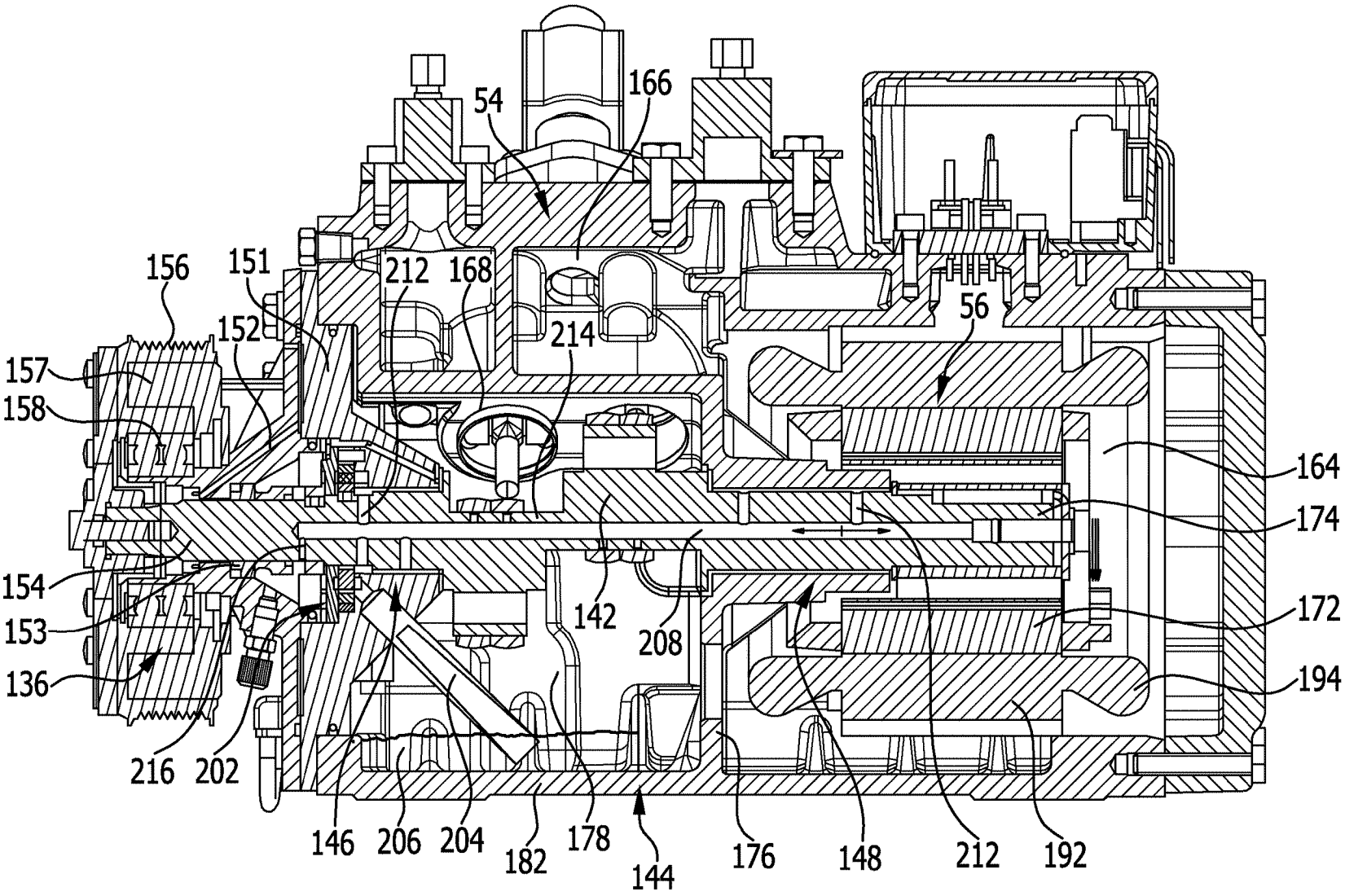
FIG. 3 shows a longitudinal sectional view through a compressor system comprising a compressor unit and a motor/generator unit according to the present invention.

As can be seen from FIG. 3 preferably clutch unit 136 is connected with a common drive shaft 142 of said compressor unit 54 and said generator unit 56, said drive shaft 142 extending in a common housing 144 of said compressor unit 54 and said generator unit 56 and being guided by two bearing units 146 and 148 within common housing 144.

For example a first axial and radial bearing unit 146 is arranged in a bearing cover 151 mounted on said common housing 144 and receiving radial and axial forces acting on drive shaft 146. On bearing cover 151 a front cover 152 of common housing 144 is mounted and drive shaft 142 extends through bearing cover 151 and front cover 152 with a shaft section 154.

Front cover 152 is provided with shaft seal 153 in order to prevent lubricant from leaving common housing 144 by passing along shaft section 154.

On shaft section 154 clutch unit 136 is arranged, which clutch unit 136 enables to connect or disconnect shaft section 154 with belt pulley 156 which, for example, surrounds clutch unit 136.

Preferably clutch unit 136 is held in place by front cover 152.

In particular belt pulley 156 is supported by front cover 152 via bearing 157 in order to receive the forces acting on pulley 156 by front cover 152 and avoid or reduce transverse forces acting on shaft section 154 to increase lifetime of shaft seal 153 and bearing 146.

Further front cover 152 is also carrying stationary coil unit 158 necessary for actuation of clutch unit 136 by applying magnetic force.

In the preferred embodiment as shown in FIG. 3 compressor unit 54 is a semi hermetic compressor having motor/generator unit 56 arranged within said common housing 144 and motor/generator unit 56 is arranged in a compartment 164 of common housing 144 through which refrigerant entering through suction port 112 is drawn before entering a suction manifold 166 of compressor unit 54 from which the refrigerant enters the respective compressor elements 168 of compressor unit 54 in order to be compressed.

Figure 4:
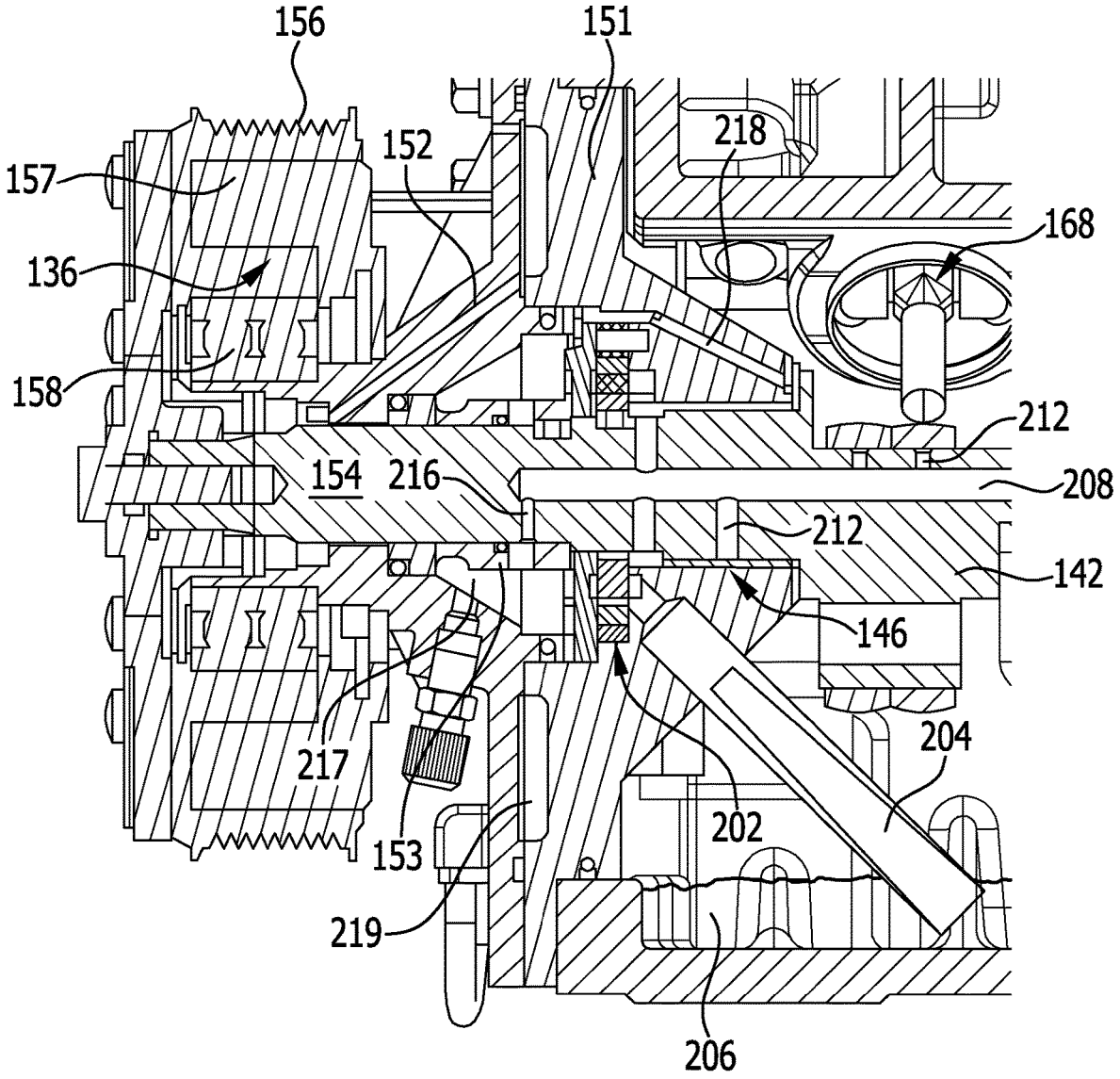
FIG. 4 shows an enlarged sectional view through the arrangement of the electric clutch and a lubricant pump of the compressor unit according to FIG. 3.

In the example shown in FIGS. 3 and 4 compressor elements 168 are cylinders of a piston compressor, however compressor elements 168 can be realized by any kind of compressor elements such as for example scroll elements of a scroll compressor or screw elements of a screw compressor.

In the embodiment shown in FIG. 3 generator unit 56 comprises a rotor 172 sitting on a shaft section 174 of common shaft 142 which extends beyond bearing unit 148 which bearing unit 148 is arranged in a central housing section 176 separating the compartment 164 receiving generator unit 56 from an interior space 178 of a drive housing 182 of common housing 144 within which drives for compressor elements 168 are arranged.

Rotor 172 is surrounded by a stator 192 of generator unit 56 which stator 192 is fixedly arranged in common housing 144 and which stator 192 is provided with electrical windings 194 whereas rotor 172 is preferably free of windings.

Generator unit 56 can be designed without permanent magnets or with permanent magnets.

In order to provide sufficient lubricant to various bearing locations of drive shaft 142 a pumping unit 202 is arranged on a section of drive shaft 142 extending beyond bearing unit 146 arranged in bearing cover 151 which pumping unit 202 is connected with a suction tube 204 extending into a lubricant sump 206 formed within a lower part of interior space 178.

Pumping unit 202 is pumping lubricant to a central lubricant channel 208 extending along drive shaft 142.

Within drive shaft 142 distribution channels 212 are provided which branch off from central lubricant channel 208 and guide lubricant to various bearing locations, for example to bearing units 146 and 148 as well as various cam drives 214 for driving compressor elements 168.

In particular a further distribution channel 216 is supplying lubricant to shaft seal 153 in order to cool shaft seal 153 and such lubricant is collected in a chamber 217 surrounding shaft seal 153 and guided to interior space 178 via channel 218.

Lubricant leaking through shaft seal 153 is collected in a chamber 218 arranged between front cover 152 and bearing cover 151.

Figure 5:
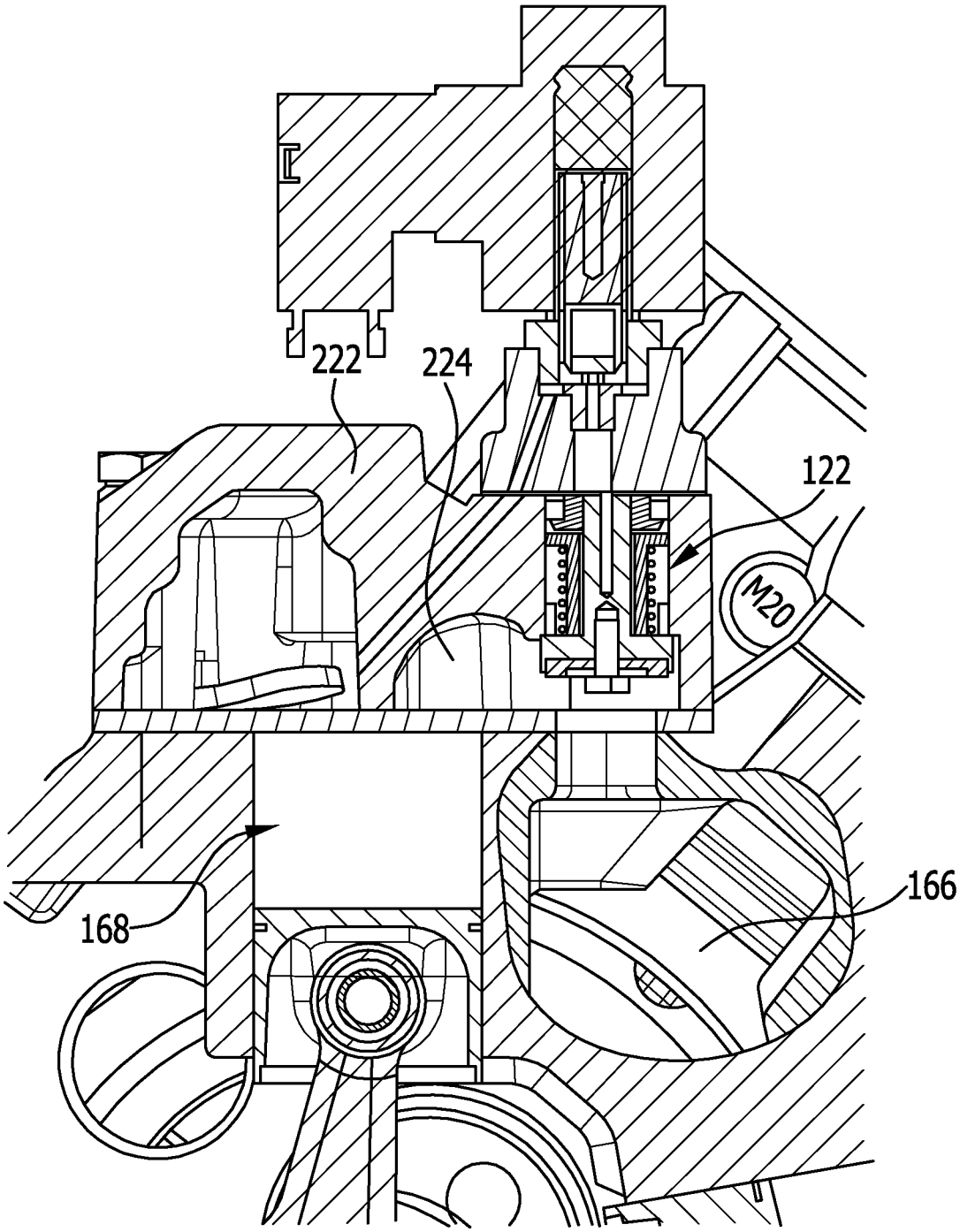
FIG. 5 shows a sectional view through a suction manifold and a cylinder head of a compressor unit according to the present invention.

As shown for example in FIG. 5 in case of compressor elements 168 comprising cylinders capacity control valves 122 are arranged in a cylinder head 222 in order to control flow of refrigerant from suction manifold 166 into the respective suction chamber 224 of the respective cylinder head 222.

If the respective capacity control valve 122 or 124 is closed, flow of refrigerant from suction manifold 166 to the respective suction chamber 224 is interrupted so that the respective compressor element 168 is prevented from compressing refrigerant and no mass flow through said compressor element 168 occurs.

As shown in FIG. 1 generator unit 56 is electrically connected to local electric mains power supply system fed by said generator unit 56 which local electric mains power supply system is used to provide electrical energy to any kind of building or any kind of office or production equipment.

In addition engine 58 as shown in FIGS. 1 and 2 is provided with an exhaust system 252 through which hot exhaust gases are flowing and exhaust system 250 is provided with an exhaust heat exchanger 252 for cooling exhaust gases and heating a heat transfer medium flowing in a heat transfer circuit 254 which heat transfer circuit 254 is connected to heat supply system 50.

Further engine 58 is provided with an engine cooling circuit 162, usually for water cooling said engine, and said engine cooling circuit 262 is either directly connected to heat supply system 50 or provided with an engine cooling heat exchanger 264 which is itself arranged in a heat transfer circuit 266 connected to heat supply system 50.

Therefore local heat supply system 50 is receiving heat from external heat exchanger 62 of refrigerant circuit 44, heat from heat transfer circuit 254 connected to the exhaust heat exchanger 252 and heat from the engine cooling circuit 262 directly or from heat transfer circuit 266 connected to engine cooling circuit via engine cooling heat exchanger 264.

Local heat supply system 50 can be used to supply heat to any kind of building equipment or any kind of production equipment or for heating heaters 46 associated with internal exchanger 42 as described before.

In particular heat supply system 50 can be a heat supply system operating with a heat transfer circuit connected to heat exchanger 62, heat exchanger 252 and engine cooling heat exchanger 264 so that the heat transfer medium is operative on one temperature level.

However heat supply system 50 can also operate at several temperature levels having several heat transfer circuits for several temperature levels, e.g. a heat transfer circuit for the temperature level provided by heat exchanger 62, and/or heat transfer circuit for a temperature level provided by exhaust heat exchanger 252 and/or a heat transfer circuit operating on a temperature level provided by engine cooling heat exchanger 264.

In addition in a further embodiment an expansion device, as disclosed for example in EP 2 743 464 A1, is used for replacing heat exchanger 252 or in addition to heat exchanger 252 in order to generate electric power by using hot exhaust gas, which electric power is supplied to local electric mains power supply system 240.

In particular the building equipment and/or the office equipment and/or the production equipment to which electrical power is supplied by local electric mains power supply system 240 and heat is supplied by heat supply system 50 is building equipment and/or office equipment and/or production equipment used in connection with the goods and/or equipment in housing 12 at a defined or set temperature range maintained by refrigerant circuit 34.

For operation of engine 58, compressor unit 54 as well as generator unit 56 as well as local heat supply system 50 and local electric mains power supply system 240 a control 270 is provided.

Control 270 enables operating of said facility in at least one of the following modes

- a general mode in which said engine 58 drives said compressor unit 54 and said generator or motor/generator unit 56 for supplying electric power to said local mains power supply system 240 and heat is supplied to said local heat supply system 50 from at least one of said external heat exchanger 62, said exhaust heat exchanger 252 and said engine cooling circuit 262,
- a primary electrical mode in which said engine 58 drives at least said generator or motor/generator unit 56 for supplying electric power to said local mains power supply system 240,
- a primary tempering mode in which said engine 58 drives at least said compressor unit 54 for providing cooling capacity to said refrigerant circuit 44,
- a primary heating mode in which said engine 58 supplies heat to said local heat supply system 50 from at least one of said exhaust heat exchanger 252 and said engine cooling circuit 262.

Control 270 for example runs engine 58 at a certain speed which is necessary for driving compressor unit 54 and/or generator unit 56.

If for example a certain level of electrical power is needed by local electric mains power supply system 240 the speed of engine 58 is adapted accordingly in order to generate sufficient power.

If in addition compressor 54 needs to be powered, the speed of engine 58 can be adapted by control 270 in order to generate sufficient electrical power by generator 56 and to power compressor unit 54 at the necessary level in order to maintain the defined or set temperature range for the goods 16 in housing 12.

In this case the heat provided by heat exchanger 62, exhaust heat exchanger 252 and engine cooling heat exchanger 246 is transferred to local heat supply system 50 which is controlled in order to distribute the heat where needed or to store the heat in a heat storage unit 268.

If only electrical power is needed by local electric mains power supply system 240 control 270 will actuate capacity control valves 122, 124 of compressor unit 54 in order to reduce the compressor capacity to the desired level, for example to 0% if no compressor capacity is needed in cooling circuit 44.

If for example the maximum cooling capacity is needed by compressor 54 and now electrical power is needed by local electric mains power supply system 240 control 270 can either control electric mains power supply 240 to store electric energy in electric power storage unit 242 or control 270 can control generator 56 in order not to generate any electrical power.

In case only heat is needed by heat supply system 50 heat control 270 can control heat supply system 50 to extract heat from heat storage unit 268 or if there is no heat stored in heat storage unit 268 control 270 can control engine 58 to run at a certain speed in order to provide sufficient heat for heat supply system 50 and for example control 270 can further control generator 58 to generate the electric power supply to electric main supplied system 240 which is then stored in electric power storage unit 242 whereas—if no compressor capacity is needed—valves 122,124 can be actuated in order to reduce compressor capacity to 0%.

In an improved version of the first embodiment shown in FIGS. 1 to 5 it is possible to use a generator unit 56 which is not only a generator unit but also a motor/generator unit so that in case electric mains power supply 250 is powered by other sources or by electrical power storage means 242 so that it is possible to run compressor 54 by motor generator unit 56 operating as a motor without the need to run engine 58.

In this case the heat generated is only the heat generated in heat exchanger 62 which can be supplied to heat supply system 50.

Figure 6:
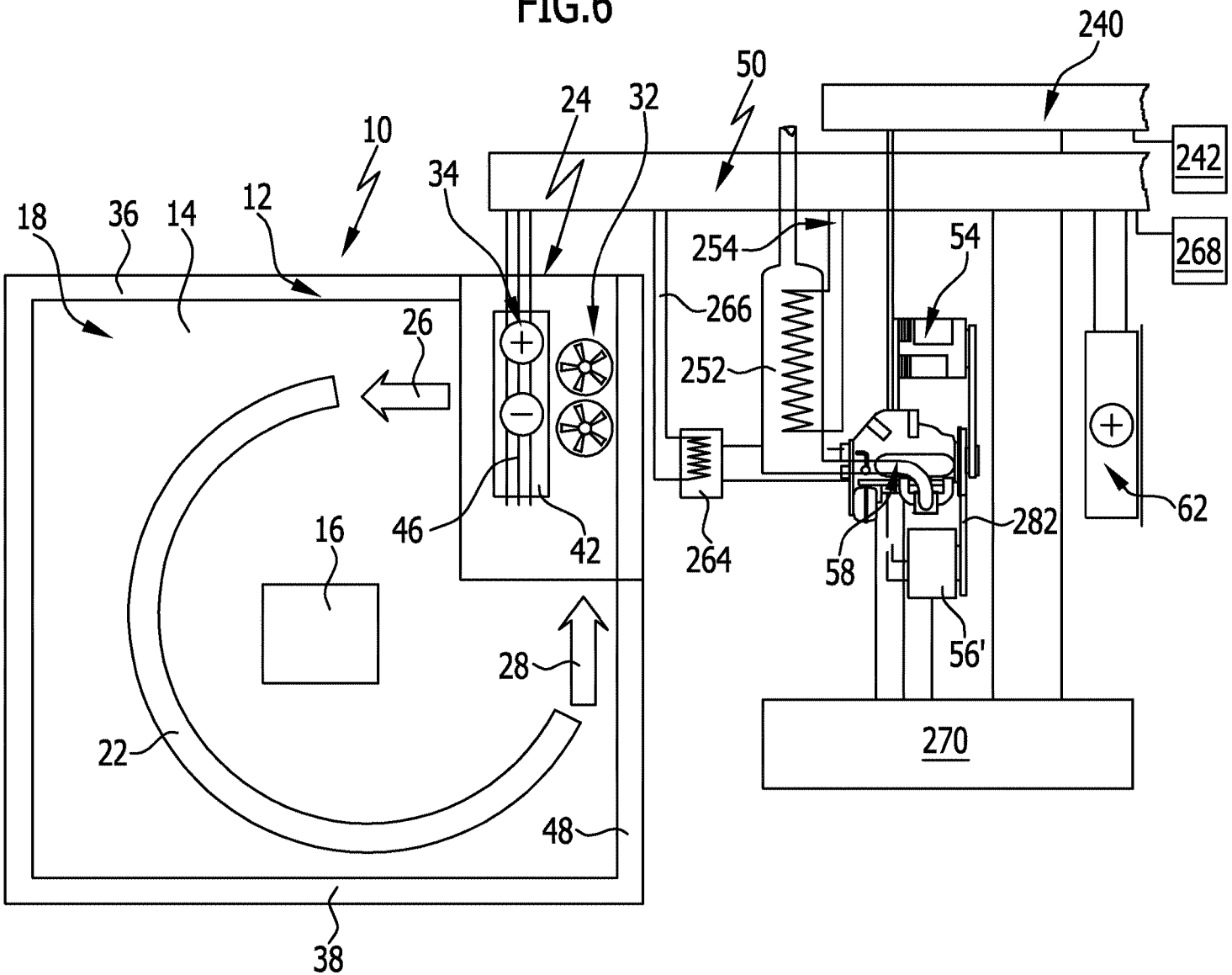
FIG. 6 shows a schematic representation of one part of the various features of a facility according to a second embodiment of the present invention and FIG. 7 shows a schematic representation similar to FIG. 2 of the second embodiment.
Figure 7:
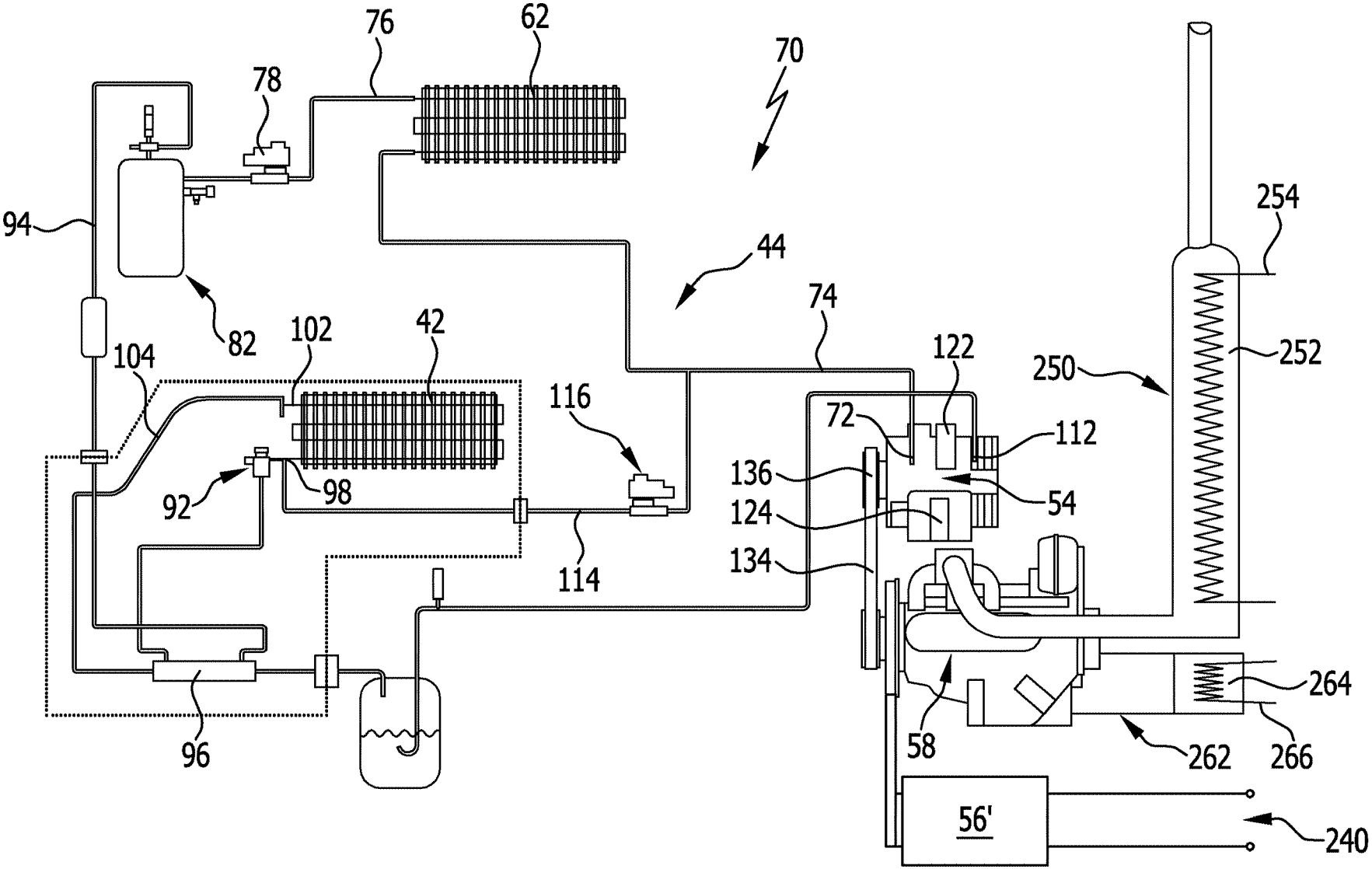

In a second embodiment, shown in FIGS. 6 and 7, the generator units 56' is not forming an integral unit with compressor unit 54 but arranged separately therefrom so that generator unit 56' is driven by a belt drive 282 by engine 58.

This enables—in case no compressor capacity is needed in refrigerant circuit 44 to decover drive shaft 142 by releasing clutch unit 136 from engine 58 so that engine 58 is only driving generator unit 56 via belt drive 282.

In this case—in particular if electrical power in electrical mains power supply 240 is needed in cases no compressor capacity is necessary to fully decouple compressor unit 54 so that all losses in compressor unit 54 in cases no compressor capacity is needed, are avoided.

With respect to all other elements of the second embodiment those elements which are identical with the first embodiments are designated by the same reference numerals so that with respect to their operation reference can be made to the explanations in connections with the first embodiment.

The invention claimed is:

1. A facility, comprising: a storage unit comprising an insulated container housing enclosing a storage volume for receiving (a) goods or (b) equipment or (c) both goods and equipment, and further comprising at least one operating system provided with a tempering unit associated with said storage volume for maintaining a defined or set temperature in said storage volume, said at least one operating system being provided with a refrigerant circuit comprising an internal heat exchanger, arranged in said tempering unit, an external heat exchanger as well as a compressor unit for compressing refrigerant, said at least one operating system is provided with an internal combustion engine for driving said compressor unit as an independent power source and said at least one operating system is provided with an electric generator unit mechanically coupled to said internal combustion engine, (a) said compressor unit or (b) said electric generator unit or (c) both said compressor unit and said electric generator are driven by said internal combustion engine as the independent power source, and said at least one operating system is connected to a local energy supply system of said facility, said local energy supply system comprising a local electric mains power supply system connected to said electric generator unit in order to feed electric power to said local electric mains power supply system of said facility, wherein the facility is independent from any mains power supply system powered by a power plant.

2. The facility according to claim 1, wherein said local energy supply system comprises a local heat supply system.

3. The facility according to claim 2, wherein said local electric mains power supply system is designated to supply electric power to at least one of a building equipment, an office equipment or a production equipment of said facility.

4. The facility according to claim 2, wherein said local electric mains power supply system comprises an electric power storage unit.

5. The facility according to claim 2, wherein said electric generator unit is a motor/generator unit which in a dependent power source mode receives electric power from said local electric mains power supply system for driving said compressor unit.

6. The facility according to claim 2, wherein said local heat supply system is connected to a heater associated with said tempering unit.

7. The facility according to claim 2, wherein said local heat supply system is provided with a heat storage unit.

8. The facility according to claim 2, wherein said local heat supply system is designed to supply heat to at least one of a building equipment, an office equipment or a production equipment of said facility.

9. The facility according to claim 1, wherein said external heat exchanger is connected to a local heat supply system comprised by said local energy supply system.

10. The facility according to claim 1, wherein said internal combustion engine is provided with an exhaust heat exchanger connected to a local heat supply system comprised by said local energy supply system.

11. The facility according to claim 1, wherein said internal combustion engine is provided with engine cooling circuit connected to a local heat supply system comprised by said local energy supply system.

12. The facility according to claim 1, wherein said electric generator and said compressor unit are directly coupled by a shaft.

13. The facility according to claim 1, wherein said electric generator and said compressor unit are driven by a common drive shaft.

14. The facility according to claim 1, wherein a control is provided enabling operating of said facility in at least one of the following modes a general mode in which said internal combustion engine drives said compressor unit and said electric generator for supplying electric power to said local mains power supply system and heat is supplied to a local heat supply system from at least one of said external heat exchanger, an exhaust heat exchanger and a engine cooling circuit, a primary electrical mode in which said internal combustion engine drives at least said electric generator for supplying electric power to said local mains power supply system, a primary tempering mode in which said internal combustion engine drives at least said compressor unit for providing cooling capacity to said refrigerant circuit, a primary heating mode in which said internal combustion engine supplies heat to said local heat supply system from at least one of said exhaust heat exchanger and said engine cooling circuit.

15. The facility of claim 1, wherein said local electric mains power supply system of the facility is not connected to any the power plant but only powered by said at least one operating system.

16. At least one operating system for a facility having a storage unit, said storage unit comprising an insulated container housing enclosing a storage volume for receiving (a) goods or (b) equipment or both goods and equipment, said at least one operating system comprising:

a tempering unit associated with said storage volume for maintaining a defined or set temperature in said storage volume, a refrigerant circuit comprising an internal heat exchanger, arranged in said tempering unit, an external heat exchanger as well as a compressor unit for compressing refrigerant, an internal combustion engine for driving said compressor unit as an independent power source and an electric generator unit mechanically coupled to said internal combustion engine, (a) said compressor unit or (b) said generator unit or (c) both said compressor unit and said generator unit are driven by said internal combustion engine as the independent power source, and wherein said at least one operating system is connected to a local energy supply system of said facility, said local energy supply system comprising a local electric mains power supply system connected to said electric generator unit in order to feed electric power to said local electric mains power supply system of said facility, wherein the facility is independent from any mains power supply system powered by a power plant.

17. The at least one operating system according to claim 16, wherein said local energy supply system comprises a local heat supply system.

18. The at least one operating system according to claim 16, wherein said internal combustion engine is provided with at least one of an exhaust heat exchanger designed to be connected to a local heat supply system comprised by said local energy supply system, of said facility and in particular with an engine cooling circuit designed to be connected to a local heat supply system of said facility.

19. The facility of claim 16, wherein said local electric mains power supply system of the facility is not connected to the power plant but only powered by said at least one operating system.

* * * * *